United States Patent [19]

Paciorek

[11] Patent Number: 4,603,452

[45] Date of Patent: Aug. 5, 1986

[54] DETACHABLE HINGE WITH CONVENIENTLY RELEASABLE HINGE FLAPS

[75] Inventor: Peter M. Paciorek, Fort Worth, Tex.

[73] Assignee: General Dynamics Corporation, Fort Worth, Tex.

[21] Appl. No.: 693,063

[22] Filed: Jan. 22, 1985

[51] Int. Cl.[4] ..... E05D 5/12; E05D 7/12

[52] U.S. Cl. ..... 16/262; 16/381; 16/386

[58] Field of Search ..... 16/229, 257, 258, 262, 16/263, 265, 266, 301, 380, 381, 386

[56] References Cited

U.S. PATENT DOCUMENTS

| | | | |
|---|---|---|---|
| 353,007 | 11/1886 | Schubert et al. | 16/262 X |
| 676,509 | 6/1901 | McNown . | |
| 782,428 | 2/1905 | Struble et al. . | |
| 1,029,629 | 6/1912 | Pleins . | |
| 1,908,383 | 9/1933 | Vice | 16/381 X |
| 2,794,208 | 6/1957 | Scroggins . | |
| 2,951,670 | 9/1960 | Aberer | 16/262 X |
| 3,805,325 | 4/1974 | Lee | 16/262 |
| 3,978,551 | 9/1976 | Mochizuki | 16/301 |

FOREIGN PATENT DOCUMENTS

| | | | |
|---|---|---|---|
| 622577 | 4/1981 | Switzerland | 16/258 |

*Primary Examiner*—Fred Silverberg

*Attorney, Agent, or Firm*—Charles E. Schurman; James E. Bradley

[57] ABSTRACT

An easily separable but conventional-appearing hinge wherein the hinge flaps can be connected or disconnected to/from one another without relative lengthwise displacement of the flaps by employing short axial movement of the hinge pin. The flaps thus may be hingedly securely connected together, or disconnected and separated within limited space. The flaps have tubular knuckles with adjacent space or gaps so knuckles of one flap can be interdigitated with knuckles of the other flap and held together by the hinge pin. Knuckles of one flap are slotted longitudinally forming open sided or split tubes; those of the other flap are fully tubular, i.e., unslotted. The removable hinge pin has adjacent cylindrical and flat portions, the latter positionable in gaps longitudinally aligned with the full tube knuckles of one of the flaps. The slotted knuckles of the other flap can be fitted transversely over the pin's flat portions thereby axially aligning the knuckles of both flaps with the pin fully encased and axially slidable therein. So positioned, the flaps can be disengaged by sliding the slotted knuckles in reverse transverse direction until free of the pin's flat segments. The flaps lock together for normal hinge action, or unlock for separation, by short axial movement of the pin between a locked position in which the pin's cylindrical portions are within the slotted knuckles and an unlocked position in which the pin's flat portions are within the slotted knuckles. One flap has a spring well with coil spring therein axially of the hinge pin to normally bias the pin to the flap-locking position. Pin actuator means can be provided to move the hinge pin between locked and unlocked positions and to rotate the pin to direct edges of the flat segments towards the slots of the open-sided knuckles.

18 Claims, 8 Drawing Figures

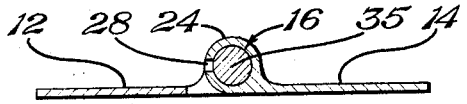
Fig.5
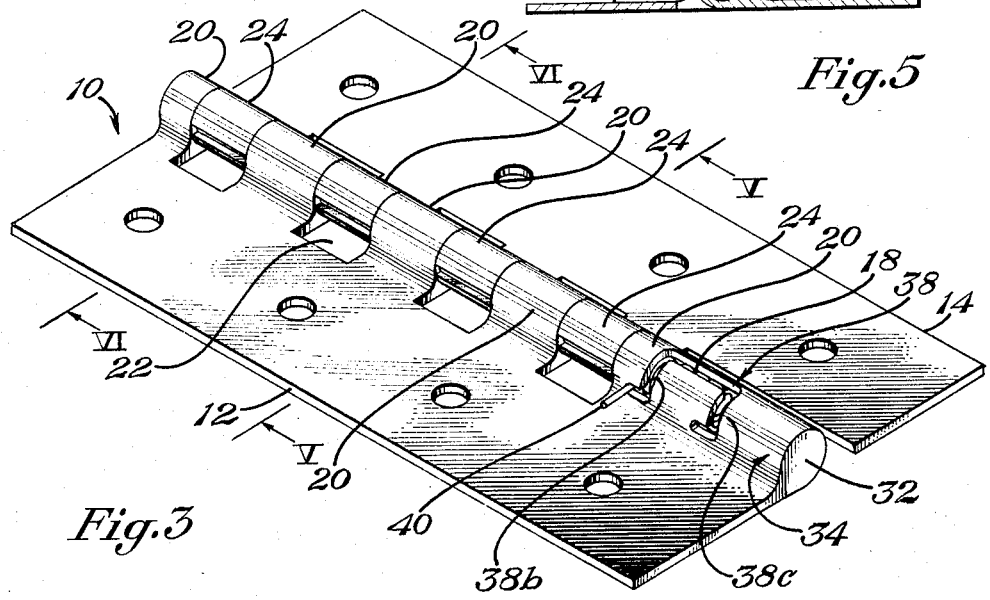
Fig.3
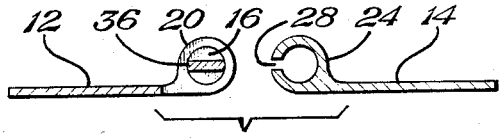
Fig.4
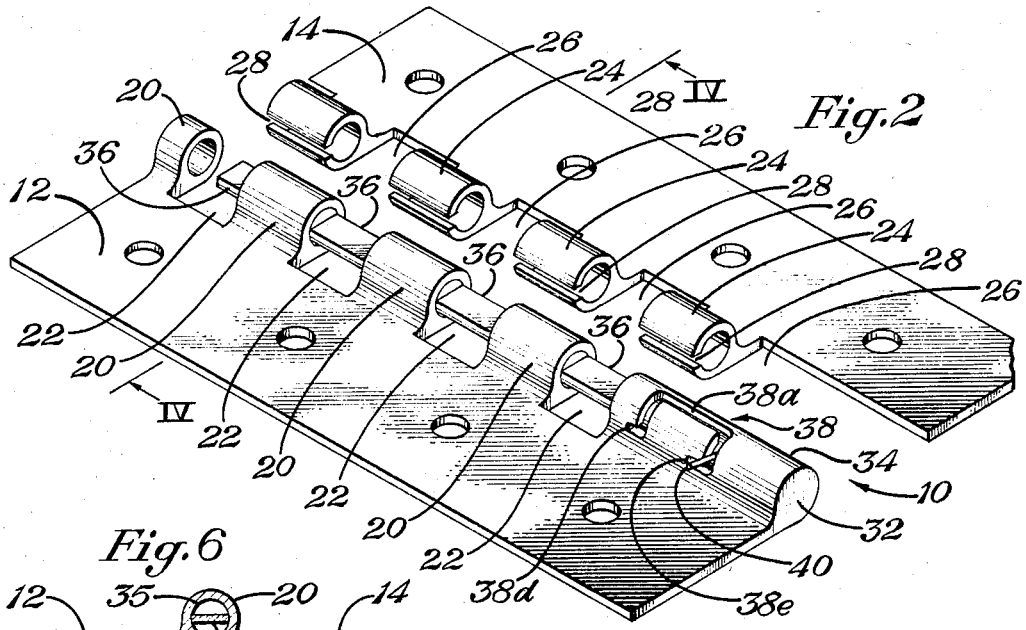
Fig.2
Fig.6
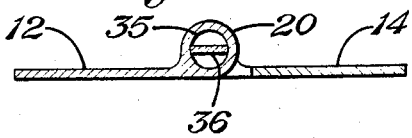

DETACHABLE HINGE WITH CONVENIENTLY RELEASABLE HINGE FLAPS

The Government has rights in this invention pursuant to Contract No. 33657-75-C-0310 awarded by the Department of the Air Force.

BACKGROUND OF THE INVENTION

Various detachable hinge devices have provided a capability for detaching or separating the hinge flaps one from the other so the underlying structures to which they respectively attach may be separated or disassembled without need to remove one or both of the hinge flaps from those structures. However, in order to attach one flap to the other or to disconnect them, it has usually been necessary to skew one flap with respect to the other or to displace one flap longitudinally of the other. Both of these actions may require considerable or unavailable workspace to accomplish separation of the underlying structures. With other detachable hinges, the flaps may undesirably be separable, e.g., at particular rotational positions of the flaps even though apparently connected, for example as in U.S. Pat. Nos. 782,428 to Struble and Cain and 2,794,208 to Scroggins. Still other detachable hinge devices have required such atypical construction as to give the hinge a non-conventional appearance, for example by auxilliary strap attachments connecting between the opposing hinge flaps as disclosed in U.S. Pat. No. 3,805,325 to Lee. Such externals may also cause airflow turbulence in aircraft use. In cases where the hinge pin must be removed to allow the flaps or plates to be separated, typically, an exposed portion of the hinge pin must be permanently crimped to prevent its accidental removal so requiring damaging or destruction of the pin in order to release it. The invention herein overcomes the above and other prior art disadvantages.

SUMMARY OF THE INVENTION

The present invention provides a conventional-appearing detachable hinge or hinge device wherein left and right hinge plates or flaps may be easily and quickly assembled and securely locked together at all pivotal positions of the flaps, or disassembled to remove one flap from the other, without skewing or longitudinal displacement of one flap relative to the other. Assembly or disassembly of the hinge can thus be conveniently made within limited working space or limited access to its place of attachment to a structure. The hinge has first and second flap means each with one or more substantially tubular knuckle means or bearings separated by or having adjacent gap means. The knuckle means of one flap can thus be interdigitated with knuckle means of the other flap in the usual way to be held in axial alignment by a hinge pin passing through the knuckles of both flaps. The pin is segmented such that in one axial position of the pin in the knuckles the flaps are hingedly locked together and in another axial position the flaps can be disengaged and separated. The hinge pin is non-uniform in cross section lengthwise as by being formed of joined alternate or successive cylindrical and flat segment means along its length. The knuckle means of one of the flaps is substantially fully tubular in cross section while the knuckle means of the other flap is interrupted by lengthwise slot means so as to be open along one side. The flat segment means of the hinge pin can pass edgewise through the slot means to the interior of the slotted knuckle means or be removed therethrough. The hinge flaps can be assembled so as to be locked together at all pivotal positions by sliding the pin axially into the fully tubular knuckle means of the first (e.g., left) flap, positioning the pin's flat segment means in the gap means adjacent such knuckle means and opposite the slot means in the open knuckle means of the other (e.g., right) flap, sliding the slotted knuckle means over the flat segment means of the hinge pin to align the knuckle means of both flaps and thereafter sliding the hinge pin axially to place the cylindrical segment means within the slotted or opensided knuckle means of the second flap. The device may then be used as an ordinary door type hinge. Disassembly is by reverse procedure. Advantageously, spring means biases the hinge pin to the locked position. Pin positioning means such as a rod or push button may be attached to or be part of the hinge pin for manually applying axial and rotational force to the pin to place it is desired and prevent unwanted movement.

It is a particular object, accomplished by this invention, to provide a simplified hinge device which minimizes or reduces the effort and working space or clearances necessary to hingedly engage or disengage associated structural members in limited access areas without the removal or release of any of the hinge device's components from underlying structures to which they are attached. The invention has particular usefulness with hinged aircraft fuselage access panels and doors and in cabinetry.

Another object is to provide a quick engagement-/quick release mechanism for hingedly attaching and detaching one structural member to another.

A further object is to provide a simplified hinge device providing for hinge attachment of one structural component to another by only short straight lateral movement, i.e., transverse of the hinge pivot axis, of one hinge flap or plate towards the other, followed by short axial shifting of the hinge pin.

The foregoing and other objects and advantages will become more apparent to those skilled in the art upon an understanding of the preceding text and the drawings and explanations following including description of a preferred embodiment, all being given as only exemplary and not by way of limitation.

BRIEF DESCRIPTION OF THE DRAWINGS

FIG. 2 is a view in perspective of the hinge device of FIG. 1, partially assembled;

FIG. 3 is a view in perspective of the hinge device of FIGS. 1 and 2 fully assembled with the flaps hingedly locked together;

FIG. 4 is a cross sectional view taken along line IV—IV of FIG. 2;

FIG. 5 is a cross sectional view taken along line V—V of FIG. 3;

FIG. 6 is a cross sectional view taken along line VI—VI of FIG. 3;

DESCRIPTION OF THE PREFERRED EMBODIMENT

Figure 1:
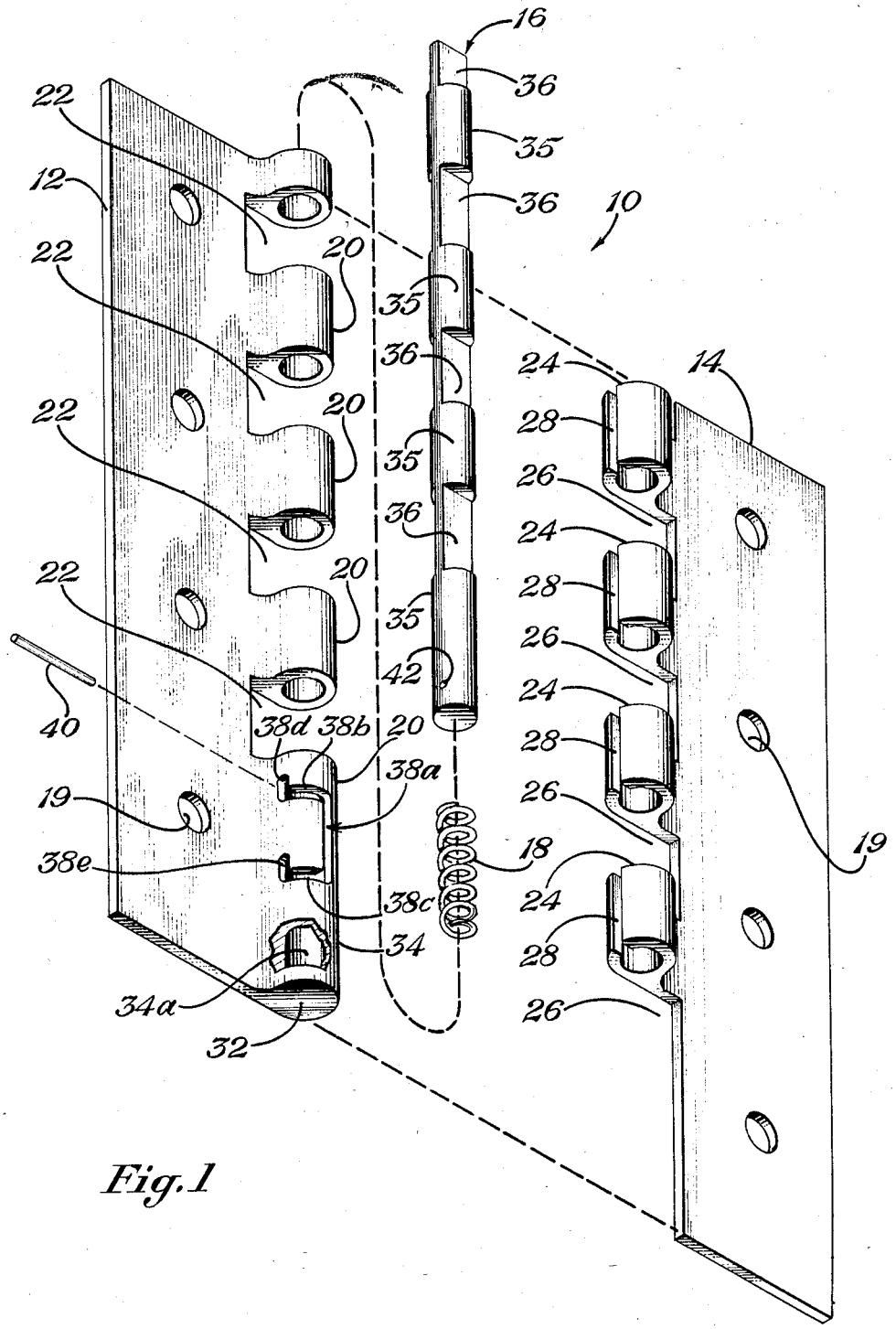
FIG. 1 is an exploded perspective view, partly in section, of a hinge device of this invention.

Referring to the Figures, FIGS. 1 through 6 depict a preferred embodiment of the quick release, separable type hinge or hinge device 10 of this invention. The hinge includes a first or left hinge flap 12, a second or right hinge flap 14 and a hinge pin 16 with its biasing means or coil spring 18. The flaps or attachment plates are provided with suitable fastener holes 19 to receive the usual fasteners such as nails or screws (not shown).

Left flap 12 is formed and undercut at one side in a castellated formation of closed circumference or substantially fully tubular knuckle means or knuckles 20 longitudinally alternated with left gap means or gaps 22 in the manner of a standard type door hinge. Right flap 14 is similarly formed, having substantially tubular but slotted or split knuckle means or knuckles 24 spaced apart by right gap means or gaps 26. The knuckles and gaps of respective right and left flaps are longitudinally offset so the knuckles of opposite flaps can be interdigitated or fitted between one another by movement into the gaps opposite so as to align the knuckles of both flaps just as with standard door hinge types and to give the appearance of such hinges or standard back flaps as the case may be. Split knuckles 24 are each open at one side by means of knuckle openings or slots 28 which extend the length of the knuckles through their tubular walls in a plane parallel to the plane of the flap (see FIGS. 1 and 4).

The lowermost knuckle of flap 12 is made longer than the other knuckles and is closed at its lower end 32 terminating at the lower edge of the flap to form a tubularly hollow spring well or socket 34. The socket is adapted to receive the coil spring 18 seating in the base or lower end of the socket and to slideably receive the lower end of the hinge pin to seat against the upper end of the spring.

For quickly connecting together or permitting quick detachment and separation of one hinge flap to/from the other, the hinge pin 16 is formed along its length of alternating cylindrical segments 35 and flat segments 36. The edges of the flat segments are formed with the same radius of curvature as the cylindrical segments and the width of the flat segments at their widest part is the same as the diameter of the cylindrical segments. In the embodiment of FIGS. 1–6 in which the hinge pin does not extend beyond the confines of, or perimeter formed by, the flaps, the hinge pin is of a length that, with spring 18 positioned in the bottom of socket 34 and uncompressed, the hinge pin can be inserted into knuckles 20 and with the lower end of the pin resting on the spring the top end of pin is at the upper edge of the flaps (see FIGS. 1 and 3). When the hinge pin and spring are thus in place, it can be seen from comparison of FIGS. 1 and 2 that the hinge pin can be moved axially against the spring by pressing downwardly on the top or free end of the hinge pin, compressing the spring such that the pin will be in the position shown in FIG. 2. It will thus be evident that when the spring is uncompressed the flat segments 36 will be within the knuckles 20 and cylindrical segments 35 within the gaps 22. But when the spring is compressed the cylindrical segments are within knuckles 20 and the flat segments are in the respective gaps 22. The thickness of flat segments 36 and the dimensions of the openings or slots of right flap knuckles 24 are such that the slots 28 can just fit or be passed over the flat segments when the latter are in gaps 22. This action simultaneously aligns the knuckles 20 and 24 so all the knuckles surround the hinge pin. Axial sliding of pin 16 in response to pressure from compressed spring 18 places the flat segments 36 within knuckles 20 of the left flap and moves the hinge pin cylindrical segments 35 to within the slotted knuckles 24 in which position the right and left flaps 12 and 14 are operatively connected to hingedly pivot about the pin 16. Axially shifting the pin in the opposite direction, i.e., against spring pressure, again places the thin, flat segments in the gaps 22 of the left flap allowing the right flap to be removed or detached from the left flap by withdrawing it laterally as the slots 28 of knuckles 24 pass over the flat surfaces of segments 36, and knuckles 20 remove from gaps 26.

Accordingly, the lengths of the flat segments 36 and cylindrical segments 35 of the hinge pin and the lengths of the knuckles and gaps of each flap are such that the split knuckles fit in gaps 22 between segments 35, and segments 36 extend substantially the full length of those gaps. Also, when the cylindrical segments 35 are in the gaps 22 the lengths of segments 35 are sufficient to provide adequate bearing surfaces within the split knuckles 24 so as to securely hold flap 14 locked to flap 12 when the hinge is fully assembled and the pin in the up or flaps-locking position. Most desireably, and as illustrated, the length of each flat segment is the same length as the gap 22 into which the flat segment moves for alignment of the knuckles of both flaps as in FIG. 2 and the length of each cylindrical segment 35 is the same as the length of the slotted knuckles 28 into which such segments are moved when the flaps are pivotably secured together. The length of the cylindrical segment 35 that moves within the knuckle forming socket 34 and the length and compressibility of spring 18 are such as to place the flat segment which is just above such segment 35 in the lower-most gap 22 when the hinge pin is in its lowest position and the upper part of the lowest cylindrical segment will be in the lower-most gap 22 when spring 18 is uncompressed and pin 16 is in its upper position. A lower cylindrical portion of the hinge pin is, then, always within the socket 34. Thus, in FIG. 2 the hinge pin is in its lower-most position compressing spring 18 and ready to receive and hold the knuckles of right flap 14 when the flaps are brought together to align the knuckles by a short straight movement of one or the other or both flaps towards the opposite flap, and the pin then moved upward a short distance. The operatively flaps locked position is shown in FIGS. 3 and 5.

Means for moving the hinge pin 16 between its upper (flaps locked) position and its lower (flaps unlocked) position and to secure or hold the pin in one or the other position for ease of assembly and locking or for disassembly of the device are provided as follows: Socket 34 is provided with a generally "U" shaped guide slot or channel 38 opening through a side area of the socket wall and located generally more towards the upper end than the lower end of the socket as shown.

Channel 38 is formed with a channel portion **38*a* lengthwise of the socket and slightly longer than the lengthwise extent of one of the gaps 22 and thus slightly longer than one of the split knuckles 24. Channel 38 also includes upper and lower circumferential channel portions 38*b* and 38*c* which are continuations of portion 38*a* at respective upper and lower ends thereof. Each of the portions 38*b*** and *c* additionally continue with short upper and lower channel notch portions **38*d* and 38*e*, respectively, in the lengthwise direction of the socket parallel to portion 38***a*.

All of the channel portions making up channel 38 are adapted to receive radially therethrough a small, pin-like detent or rod as means to position and/or hold the hinge pin, i.e., rod 40, which is removably press fitted into, but alternately could be screwed into, a small hole 42 radially in the lower end of hinge pin 16 after the pin is in place in knuckles 20. Rod 40 and the channel are sized to permit the rod to slide freely the length of channel 38

Rod 40 also is of a size and strength that when in the pin 16 (see FIGS. 2 and 3) it can be manipulated in all portions of channel 38, e.g., in channel portion 38*a* to move pin 16 axially to compress the spring and to bring the pin flat portions into gaps 22 of left flap 12. With rod 40 in channel portion 38*a* the spring normally biases pin 16 to its upper position, i.e., to its axial position in FIG. 3. The rod, fixed in the pin, can also be revolved circumferentially in channel portions 38*b* and 38*c* about the hinge pin axis for rotating the hinge pin to direct the flat segments 36 to the desired radial orientation for slipping the slotted knuckles over the pin's flat segments. Positioning the rod in these channel portions permits the advantage of having the hinge pin retained by the rod fixed optionally in the flaps locked or flaps unlocked positions. By moving the rod into notch portions 38*d* and 38*e* the rod is prevented from circumferential revolvement in either the upper or lower positions of the hinge pin. The close but free fit of the rod in the channel portions 38*b, c, d* and *e* coupled with the bias of the spring results in frictional engagement of the rod against side edges of these channel portions to hold the rod and thus the pin in the position desired which facilitates use of the hinge device particularly in close quarters.

Figure 8:
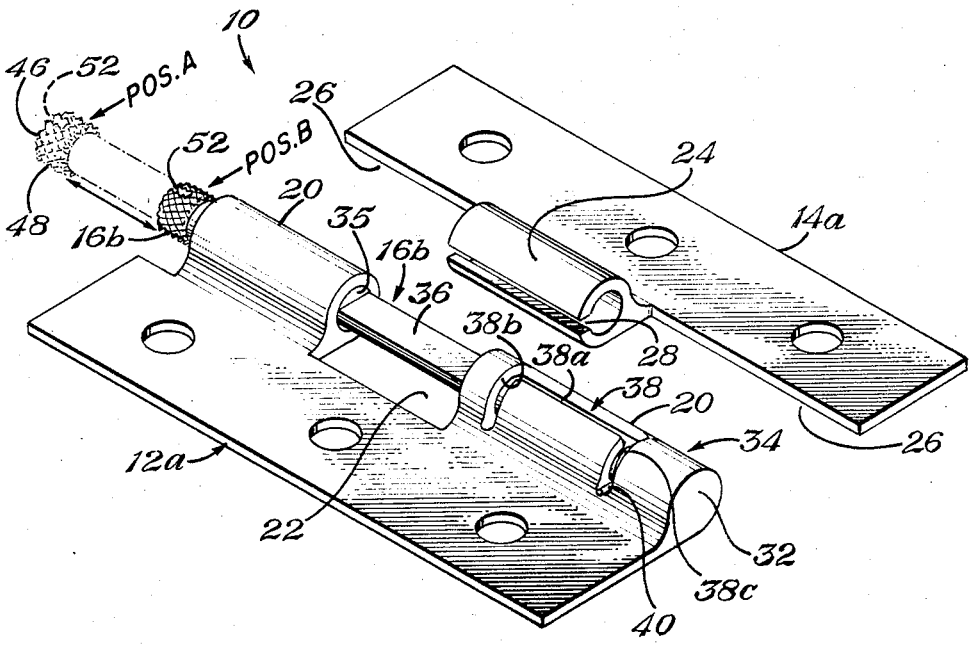
FIG. 8 is a view in perspective similar to FIG. 7 of a further alternate embodiment of this invention partially assembled, showing in broken lines the position of the hinge pin for locking the flaps together.

As an aid or alternative to using the roll rod 40 to position the hinge pin, uppermost flat segment 36 can have a screw driver slot 52, cf. FIG. 8, made in its upper end by which a narrow screw driver or similar tool can be inserted in the end of the hinge pin to both slide it axially and rotationally to direct the flat segments as desired.

Figure 7:
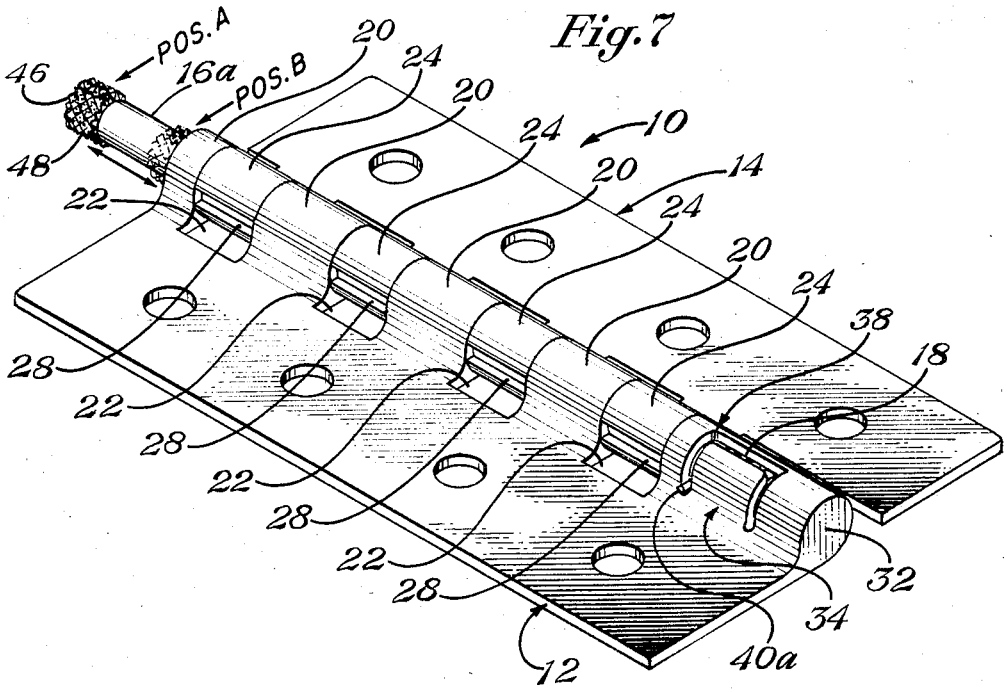
FIG. 7 is a view in perspective of an alternate embodiment of a hinge device of this invention with the parts in assembled, locked together operative position.

An alternate embodiment of a hinge device of this invention is shown in FIG. 7 in which the roll rod, there designated 40*a*, is shortened to extend substantially only to about the external circumference of the knuckle forming socket 34 to improve air flow. Also in FIG. 7, hinge pin 16*a* extends at its free end sufficiently beyond the upper edge of the flaps 12 and 14 to provide manual gripping means 46 for positioning pin 16*a*. Knurling 48 assists a firm grasp of the hinge pin and the extended top portion of the pin provides push button means for quickly digitally pressing the pin against the spring to slide it axially in the knuckles from its normal flaps locked position "A" to position "B", for quick assembly or disassembly of the flaps when the flat segments 36 are radially positioned therefor (cf. FIGS. 7 and 8).

FIG. 8 depicts a further alternate embodiment, similar to FIG. 7, illustrating how a reduced number of knuckles and gaps can be used with the invention, specifically, one split knuckle 24 on right flap 14*a* and two closed circumference knuckles 20 on left flap 12*a*. In this embodiment the hinge pin has only two of the cylindrical and one of the thin, flat, substantially rectangular, segments 36 as is apparent. A screw driver slot 52 provides additional means whereby a tool blade inserted therein permits manual force (rotational and lineal) to pin 16*b* at/from its upper end. Thus when rod 40 is made a length which can be grasped, then such forces can be applied optionally at the upper, or lower ends of the hinge pin or simultaneously at both locations thus providing flexibility in connecting or disconnecting the flaps where working space is limited, as when axially shifting or translating pin 16*b*.

From the foregoing it can be seen that the hinge device herein provides these further benefits: high strength with lower wear due to the knuckles substantially entirely surrounding the hinge pin regularly along its full length for substantially the length of the hinge, thus providing close to even weight and wear distribution along the hinge pin and the several knuckles; all hinge parts are removable with simple or no tools allowing full disassembly of the hinge parts one from the other without detaching the flaps from their respective underlying structure for inspection, cleaning and repair without deformation or break-apart of any component; release of one flap from the other without removal of the hinge pin from the device, i.e., from one of the flaps; release of one flap from the other with only their relative lateral, viz., transverse of the hinge pin, movement; and minimal external obstruction for smooth, less turbulent airflow over the hinge where desirable.

It is now also apparent that in the assembly and locking of the device the hinge pin prevents the disengagement of the right flap from the left by only short lengthwise or axial displacement of the pin to slide its cylindrical or circular cross-sectional segments 35 to within the aligned slots of the slotted knuckles. With the flaps thereby hingedly locked together, they can be rotated or turned about the hinge pin to any available position without possibility of becoming separated regardless of their rotational or pivotal positions or the radial orientation of the pin in the knuckles.

The device provides a high degree of safety assuring against undesired, e.g. accidental, flap disengagement. Accordingly, tracing the path available to rod 40, viz., the length of channel 38, shows that multiple, sequentially differing rotational and axial hinge pin placements are required to release the flaps for disengagement. This includes quadruple and triple, separate and discrete hinge pin directional movements with two, time displaced compressions of spring 18 when roll rod 40 is in the upper notch 38*d* or channel portion 38*b*, respectively. Similarly, two separate and discrete directional movements of the hinge pin with one compression or depression of the spring are required for disassembly of the flaps when the roll rod is in channel portion 38*a*. Thus, with rod 40 in notch 38*d*, i.e., the hinge pin in the fully flaps-locked-together positions, unlocking of the flaps requires, in sequence, sliding the pin axially (lengthwise) to slightly compress spring 18 and place the rod in channel portion 38*b*, then rotating the pin to where the rod is in channel portion 38*a*, then axial sliding of the pin to compress spring 18 bringing flat segments 36 to within the slotted knuckles 24 in gaps 22, then rotating the pin (as rod 40 slides in channel portion 38*c*) to align the flat segments with slots 28, as in FIG. 6. The latter step may not be required where the flaps can be pivoted to align the slots 28 with the flat segments.

The device can be formed to direct the knuckles and gaps of one or both flaps, and the slots, respectively in alignment, towards various radial directions relative to the hinge line or hinge pin axis. Also, the hinge pin can be radially aligned in various positions to allow engagement and disengagement of the flaps in the desired direction.

The flaps including knuckles, the hinge pin, roll rod and spring may be produced by appropriate methods such as casting, grinding, bending, machining, drilling, winding (spring), tempering and finishing, all as is well known in the art.

Various changes and modifications to the inventive concepts herein will occur to those skilled in the art and all such should be considered as coming within the spirit and scope of the appended claims.

What is claimed is:

1. An easily separable hinge device of conventional appearance, in which the hinge flaps may be hingedly connected together, or disconnected within limited working space by only short axial movement of the hinge pin, comprising:

first and second hinge flaps for attachment to structures to be hinged together;

each flap having tube-like knuckle means with longitudinally adjacent gap means in castellated formation with said knuckle means;

the knuckle means of one of the flaps adapted to be interdigitated and axially aligned with knuckle means of the other flap;

the knuckle means of one of the flaps provided with longitudinal slot means opening through one side thereof;

hinge pin means positionable in and pivotable in knuckle means of both of said flaps for hingedly holding one flap to the other;

said hinge pin being formed along its length with flat and cylindrical portions slidable in said knuckle means;

said slot means adapted to slide transversely of said pin over said flat portions thereof positioned in gap means of said first hinge flap to position said slotted knuckle means around the hinge pin and axially align the knuckle means of both flaps or to separate said slotted knuckle means from said pin and said first flap;

said hinge pin being axially slidable in said knuckle means between a first or unlocked position in which said flat portions are positioned in the gap means of one of the flaps whereby the knuckle means of the flaps may be brought into alignment, and a second or locked position in which said cylindrical portions are within said slotted knuckle means whereby said flaps are prevented from being separated at all pivotal positions of the flaps.

2. The hinge device of claim 1 in which said slotted knuckle means comprise a plurality of slotted tube-like knuckles each having said slot means opening radially through the length thereof and said slot means are in longitudinal alignment.

3. The hinge device of claim 1 in which said first hinge flap contains said longitudinally slotted knuckle means and the knuckle means of said second hinge flap being substantially fully tubular.

4. The hinge device of claim 1 in which the knuckle means of each of said hinge flaps comprise a plurality of spaced apart, tube-like knuckles and the gap means of each said hinge flap comprise a plurality of gaps or spaces longitudinally adjacent said knuckles, respective knuckles and gaps of each flap being in general longitudinal alignment.

5. The hinge device of claim 4 in which one or more of said knuckles are approximately equal in length to one or more of said gaps.

6. The hinge device of claim 4 in which one or more of said knuckles are different in length from one or more of said gaps.

7. The hinge device of claim 1 in which said hinge pin comprises a plurality of cylindrical segments and a plurality of flat segments in axial alignment along its length, said hinge pin being axially shiftable lengthwise within knuckle means of said device a distance approximately the length of one of said segments for operationally securing the flaps together and for separating one flap from the other.

8. The hinge device of claim 1 having biasing means associated with said hinge pin for urging the pin towards the locked position.

9. The hinge device of claim 8 in which one of said knuckles forms a socket for housing said biasing means.

10. The hinge device of claim 8 in which said biasing means is positioned in said device beyond an end of said hinge pin.

11. The hinge device of claim 8 in which said biasing means is a tubular coil spring.

12. The hinge device of claim 1 in which said hinge pin has hinge pin positioning means associated therewith for manually moving said hinge pin to desired axial and rotational positions when connecting and disconnecting said first and second hinge flaps.

13. The hinge device of claim 12 in which said hinge pin positioning means comprises pin-like rod means and the wall of said socket is cut through with slot-like channel means for receiving said rod means therethrough and guiding movement of the rod and said hinge pin.

14. The hinge device of claim 13 in which said slot-like channel provides means configured to guide said hinge pin sequentially through separate rotational and axial positions for disengagement of the flaps one from the other.

15. The hinge device of claim 12 in which said positioning means comprises handle means operatively connected to an end of said hinge pin.

16. The hinge device of claim 15 in which said handle means is axially aligned with said hinge pin.

17. The hinge device of claim 12 in which said positioning means extends transversely of said hinge pin.

18. The hinge device of claim 1 additionally comprising hinge pin locking means for maintaining said hinge pin optionally in the flaps locked or the flaps unlocked positions.

* * * * *